US008453626B2

(12) United States Patent
Holm

(10) Patent No.: US 8,453,626 B2
(45) Date of Patent: Jun. 4, 2013

(54) EGR VENTURI DIESEL INJECTION

(75) Inventor: Lars Thomas Holm, Knivsta (SE)

(73) Assignee: Concentric Skånes Fagerhult AB (SE)

( * ) Notice: Subject to any disclaimer, the term of this patent is extended or adjusted under 35 U.S.C. 154(b) by 0 days.

(21) Appl. No.: 13/219,302

(22) Filed: Aug. 26, 2011

(65) Prior Publication Data

US 2013/0047959 A1 Feb. 28, 2013

(51) Int. Cl.
*F02B 47/08* (2006.01)
*F02M 25/07* (2006.01)

(52) U.S. Cl.
USPC ..... 123/568.18

(58) Field of Classification Search
USPC ..... 123/568.17, 568.18, 568.19, 568.21, 123/568.23, 568.24, 547, 585, 586, 527; 701/108; 60/605.1, 605.2, 278, 280, 298
See application file for complete search history.

(56) References Cited

U.S. PATENT DOCUMENTS

| | | | | |
|---|---|---|---|---|
| 3,866,585 | A | 2/1975 | Kopa | |
| 3,953,548 | A | 4/1976 | Knapp et al. | |
| 3,971,351 | A | 7/1976 | McKee | |
| 4,027,636 | A * | 6/1977 | Yamamoto et al. | 123/568.19 |
| 4,635,609 | A | 1/1987 | Seppen et al. | |
| 4,735,186 | A | 4/1988 | Parsons | |
| 4,852,526 | A | 8/1989 | Brown | |
| 5,069,175 | A * | 12/1991 | Simko | 123/193.5 |
| 6,092,512 | A | 7/2000 | Ma | |
| 6,164,063 | A * | 12/2000 | Mendler | 60/274 |
| 6,202,626 | B1 * | 3/2001 | Ito et al. | 123/336 |
| 6,868,830 | B1 | 3/2005 | Meyer et al. | |
| 6,886,545 | B1 | 5/2005 | Holm | |
| 6,923,167 | B2 | 8/2005 | Flowers | |
| 7,036,529 | B2 | 5/2006 | Berggren et al. | |
| 7,076,952 | B1 * | 7/2006 | Vetrovec | 60/605.1 |
| 7,426,923 | B2 * | 9/2008 | Berggren | 123/568.18 |
| 7,721,530 | B2 | 5/2010 | Holm | |
| 7,971,564 | B2 * | 7/2011 | Kuzuyama et al. | 123/184.21 |
| 2010/0300413 | A1 | 12/2010 | Ulrey et al. | |

FOREIGN PATENT DOCUMENTS

| | | | |
|---|---|---|---|
| EP | 1905999 | A2 | 4/2008 |
| GB | 2047337 | A | 11/1980 |
| JP | 61087967 | A | 5/1986 |

OTHER PUBLICATIONS

European Search Report, Application No. EP 12 18 1690, Completed: Jan. 3, 2013; Mailing Date: Jan. 15, 2013, 10 pages.

* cited by examiner

*Primary Examiner* — Mahmoud Gimie
(74) *Attorney, Agent, or Firm* — St. Onge Steward Johnston & Reens LLC

(57) ABSTRACT

An arrangement for mixing a first and a second gas flow, for example, an inlet flow with an exhaust gas return flow in a diesel engine. An air conduit has an inlet for the first flow and an inlet for the second flow, in order to achieve the mixing. A valve body is arranged to be displaced in the longitudinal direction of the air conduit at the inlet for the second flow in order to achieve a variable venturi effect and in this way a variable suction effect and mixture of the mixed flow. One or more fuel injectors inject fuel into the air conduit to pre-mix fuel with the first and second gas flows before reaching the engine cylinders for combustion.

33 Claims, 5 Drawing Sheets

EGR VENTURI DIESEL INJECTION

FIELD OF THE INVENTION

The present teachings relate generally to exhaust gas recirculation in internal combustion engines and, more particularly, to a diesel fuel-injected exhaust gas recirculation system.

BACKGROUND OF THE INVENTION

As is well known, internal combustion engines operate by introducing fuel into fuel cylinders. Energy is released in the form of expanding gas due to rapid combustion of the fuel, which acts upon pistons and converts the chemical energy of the fuel into mechanical energy. The pistons are connected to a crankshaft, and the linear, up-and-down motion of the pistons translates into the rotary motion needed to turn the wheels of a vehicle. In order to produce the rapid combustion, fuel is mixed with intake air, either before or after the air is compressed, and then ignited in order to cause combustion. After this combustion takes place, the leftover exhaust gases are forced out of the cylinder and subsequently expelled into the environment or, more recently, treated and/or recirculated into the engine intake, which is known as Exhaust Gas Recirculation (EGR).

During the turbo charging of diesel, for example, although not limited thereto, the pressure of the exhaust gases in most cases is less than the intake air, and exhaust gases can therefore not be efficiently recirculated without measures being taken for achieving a sufficient supply of exhaust gases. Such measures may take the form of, for example, venturi solutions, exhaust throttles or inlet throttles.

By placing a venturi in the inlet flow, an advantageous difference in pressure between the exhaust channel side and the air intake inlet channel side is achieved locally in the venturi, and exhaust gases, which are removed upstream of the turbo, can be fed into the inlet pipe of the engine. A reduced NOx level is obtained as a result of the lower combustion temperature. However, traditional venturi solutions have been associated with disadvantages in the form of, for example, reduced engine power through high pressure losses, together with increased fuel consumption and smoke development.

U.S. Pat. No. 7,036,529 (Berggren et al.), which is hereby incorporated by reference in its entirety, obviates problems associated with the prior art by providing an EGR system which includes a streamlined body arranged to be displaced in the longitudinal direction of a line near the EGR inlet. The body allows for achievement of a variable venturi effect and in this way a variable suction effect and mixture of the mixed flow. The system also includes an actuator for displacing the body forwards and backwards in the line.

Intake air and EGR then flows to the engine. Fuel is traditionally injected directly into the cylinders of a diesel engine, resulting in an inhomogeneous charge and a diffusing flame where the injected amount of fuel is metered to control power output. However, injecting the fuel directly in the cylinders does not allow for optimum fuel/air mixture for combustion.

Therefore, it would be beneficial to have a superior system and method for exhaust gas recirculation (EGR) venturi diesel injection.

SUMMARY OF THE INVENTION

The needs set forth herein as well as further and other needs and advantages are addressed by the present embodiments, which illustrate solutions and advantages described below.

The system of the present embodiment includes, but is not limited to, an air conduit having an inlet for a first gas flow and through which air flows to the engine, said air conduit having a reduced portion. A valve body is arranged to be displaced in a longitudinal direction of the air conduit in order to achieve a variable venturi effect and in this way a variable suction. One or more fuel injectors are positioned at or upstream from the valve body to inject fuel into the air conduit. In this way, fuel injected into the air conduit mixes with the gas flow to create a mixture before said mixture flows to the engine for combustion.

The method of the present embodiment includes the steps of, but is not limited to, supplying a first gas flow to an engine through an air conduit having a reduced portion; positioning a valve body in a longitudinal direction within the air conduit in order to achieve a variable venturi effect and in this way a variable suction; and injecting fuel in the air conduit at a position at or upstream from the valve body. The fuel injected into the air conduit mixes with the gas flow to create a mixture before said mixture flows to the engine for combustion.

Other embodiments of the system and method are described in detail below and are also part of the present teachings.

For a better understanding of the present embodiments, together with other and further aspects thereof, reference is made to the accompanying drawings and detailed description, and its scope will be pointed out in the appended claims.

DETAILED DESCRIPTION OF THE INVENTION

The present teachings are described more fully hereinafter with reference to the accompanying drawings, in which the present embodiments are shown. The following description is presented for illustrative purposes only and the present teachings should not be limited to these embodiments.

Figure 1:
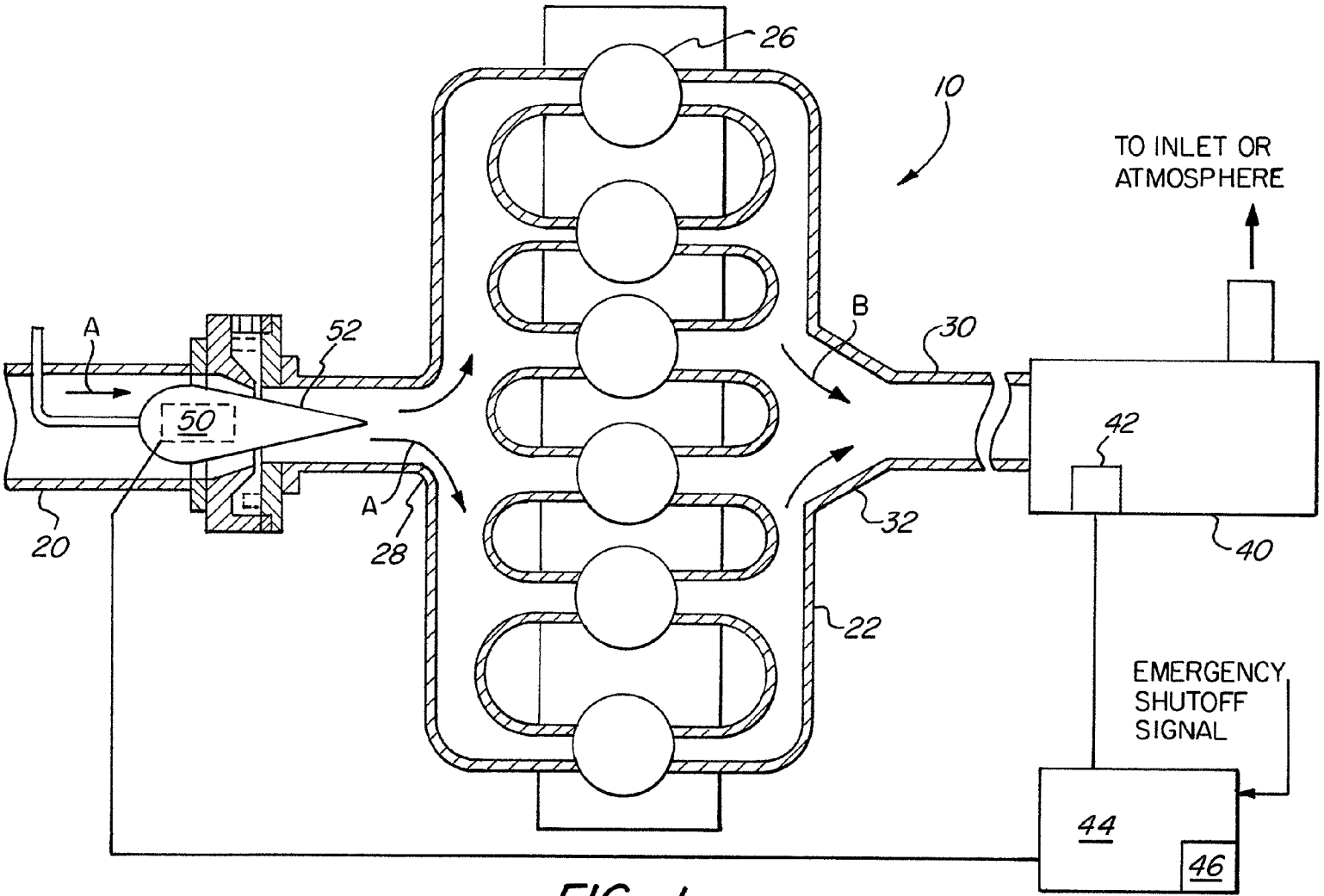
FIG. 1 is a schematic view of one embodiment of a system for controlling the intake airflow of an engine according to the present teachings.

The basic components of one embodiment of an engine intake control system 10 in accordance with the teachings are illustrated in FIG. 1. As used in the description, the terms "top," "bottom," "above," "below," "over," "under," "above," "beneath," "on top," "underneath," "up," "down," "upper," "lower," "front," "rear," "back," "forward" and "backward" refer to the objects referenced when in the orientation illustrated in the drawings, which is not necessary for achieving the objects of the present teachings.

The present teachings involve the injection of fuel into EGR (exhaust gas recirculation) for internal combustion engines, including diesel and gasoline engines, although not limited thereto. Generally, a variable venturi is placed upstream of the engine, and includes a main inlet for fresh air intake and another inlet for introducing exhaust gas recirculated from the engine outlet. The tapered structure of the venturi serves to 'pump' the exhaust gas into the line, and a valve body may be used to control the rate at which the exhaust gas is mixed with the inlet air.

Typically, diesel fuel is injected directly into the cylinders of a diesel engine. However, injecting the fuel directly in the cylinders does not allow for a good fuel/air mixture for combustion. A more complete mixture can be achieved by providing a fuel injector in an EGR system to pre-mix diesel fuel with the air prior to it reaching the cylinders. Although this may not eliminate the need to inject fuel directly into the cylinders, it provides an excellent fuel/air mixture, reduces the amount of fuel required to be injected into the cylinder, allows the fuel to be injected more quickly in the cylinder, and allows for a less complicated fuel injector system. Additionally, the system helps to reduce fuel consumption and waste.

Referring now to FIG. 1, shown a schematic view of one embodiment of the system for controlling the intake airflow of an engine according to the present teachings. The system 10 includes an air conduit 20 that supplies air to an engine 22. As the air flows through the conduit 20, it may or may not flow through one or more compressors (e.g., a supercharger, turbocharger, etc.) (not shown) that compress the air, and is subsequently introduced into the cylinders 26 of the engine 22 via an intake manifold 28 (indicated by arrows A).

In the cylinders 26, fuel is injected and mixes with the air for combustion. After igniting the fuel-enriched air for combustion, the exhaust gases are discharged from the cylinders 26 and are directed to an exhaust gas conduit 30 via an exhaust manifold 32 (indicated by arrows B). As the exhaust gas flows through the exhaust gas conduit 30, it may or may not flow through the aforementioned compressor/turbocharger to spin turbines therein, which spin the compressor, thereby compressing the inlet air flowing through air conduit 20.

Typically, not all the gases are expelled via the exhaust manifold 32. This is because the engine 22 generates compression and combustion strokes via the compression and expansion of gases in the cylinder 26 to cause the movement of pistons therein and, during this process, some of the gases leak down past the piston rings and into the crankcase. Therefore, in some cases, an arrangement for also dealing with these crankcase gases is also incorporated into the exhaust system, such as that described in U.S. Pat. No. 7,721,530 to Holm, the specification of which is hereby incorporated by reference herein in its entirety.

The exhaust gas may continue through the exhaust gas conduit 30 to an exhaust gas after-treatment device 40, where the exhaust gas may be filtered prior to venting it to atmosphere and/or returning it to the inlet conduit 20 for recirculation through the system. The after-treatment device 40 may, for example, comprise a particulate filter, such as an upstream diesel particulate filter or a wall-flow diesel particulate filter, which includes an oxidation and/or reduction catalyst and a particulate filter.

When the EGR system filters the exhaust gas prior to it being recirculated this is known as a "Low Pressure" or "Long Route" system. In a "High Pressure" or "Short Route" EGR system, the exhaust gas for recirculation is routed from the exhaust manifold directly back into the inlet prior to these exhaust gases being introduced to any turbine or after treatment system.

Figure 2:
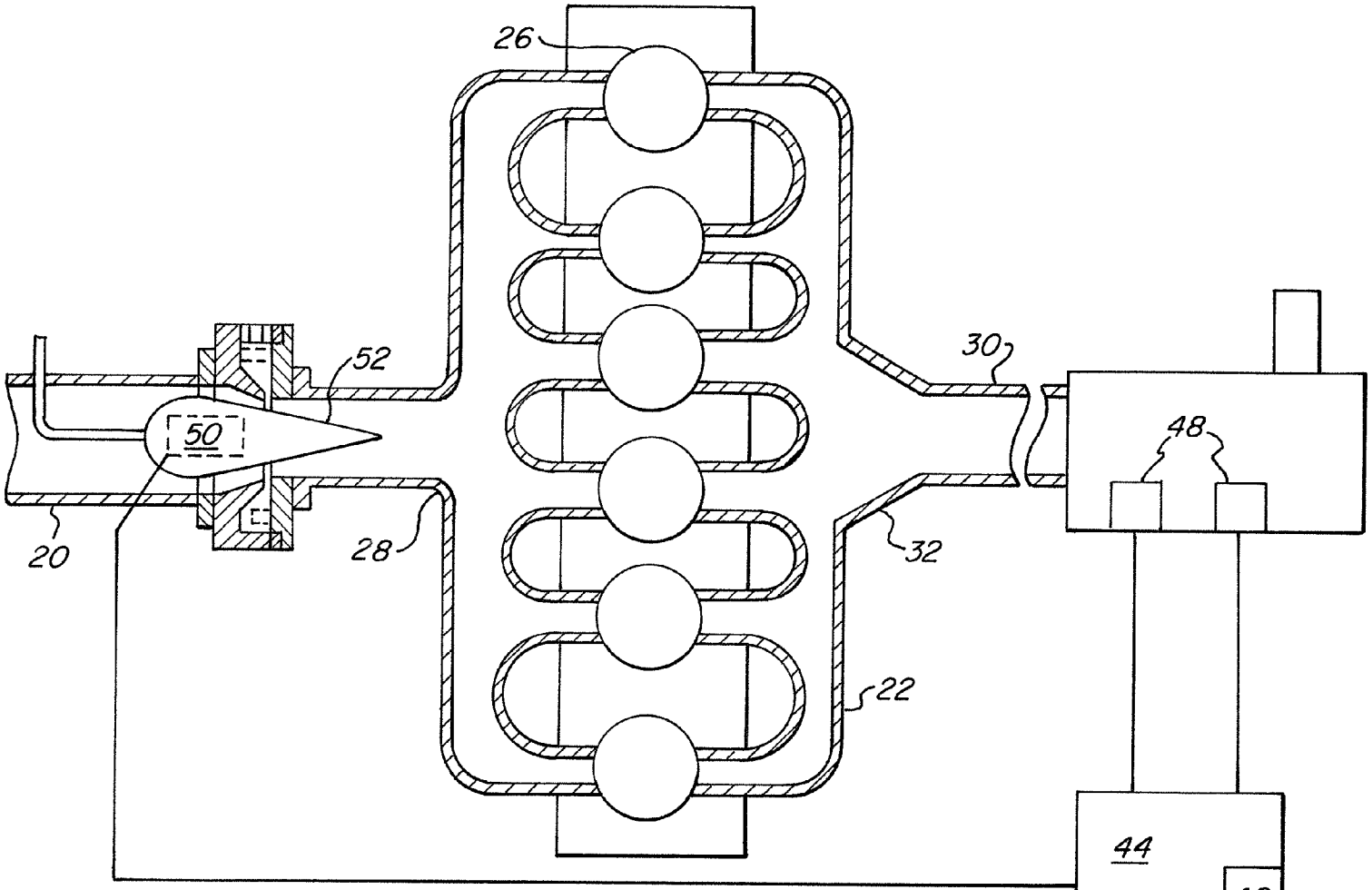
FIG. 2 is a schematic view of the system of FIG. 1 using pressure transducers for sensors in one embodiment.

At least one sensor 42 may be located in the after-treatment device 40 to measure a parameter reflecting the temperature therein and/or the pressure drop across. In certain embodiments, a temperature sensor 42 may be used for measuring the temperature inside the after-treatment device 40. However, in other embodiments, the at least one sensor may directly measure other parameters from which the temperature may be derived or estimated. For example, as shown in FIG. 2, the sensor may comprise pressure transducers 48 for measuring pressure drop.

The sensor 42 may generate a sensor signal that is communicated to a processor 44 that is in communication with the sensor 42. The processor 44, in turn, may generate a control signal based at least in part on the sensor signal received from the sensor 42, and communicate the control signal to an actuator 50 that actuates a valve body 52 in the air conduit 20, as is described in further detail below.

The processor 44 may comprise a digital processor, an analog processor, or a hybrid of both, and may be embodied in hardware, software, firmware, etc., it being understood that the precise configuration of processor 44 is unimportant so long as processor 44 is capable of performing the operations discussed herein. A single communication link may be provided for the sensor(s) 42 and the actuator 50, two separate communications links may be provided (e.g., one for connecting the sensor(s) to the processor 44 and another for connecting the actuator to the processor 44), or multiple communications links may be provided. In certain circumstances it has been found that configuring communications link(s) as a control area network (CAN) bus or as part of a CAN bus is desirable.

The processor 44 may use any of numerous means in order to generate the control signal, such as, by way of illustration (but not limitation), using a formula or algorithm, or by employing a look-up table or the like. In some cases, it may be desirable to provide processor 44 with some type of memory 46 so that formulas, algorithms, tables, etc. may be stored therein. Processor 44 may generate the control signal based at least in part upon the amount the temperature is above or below a particular established temperature appropriate for proper operation of the after-treatment device, and thus, it may be desirable to store that temperature value in memory 46. In some cases, this temperature may comprise a static value, while in other cases, it may change depending upon operating conditions, and may be calculated based upon a formula or algorithm or retrieved from a look-up table.

Figure 3A:
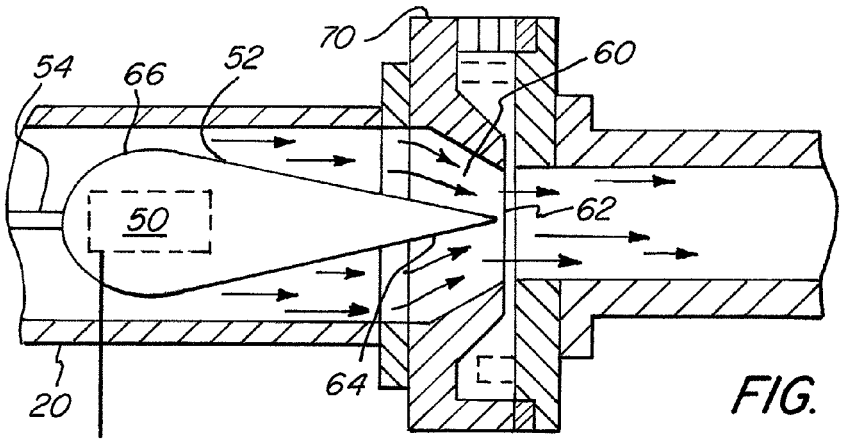
FIGS. 3A-3C are partially cross-sectional side views illustrating the throttling and shutoff of the intake airflow using the system of FIG. 1.
Figure 3B:
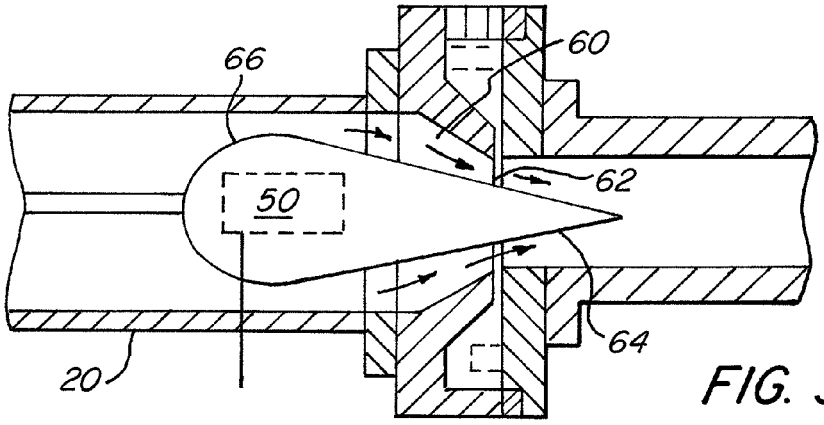
Figure 3C:
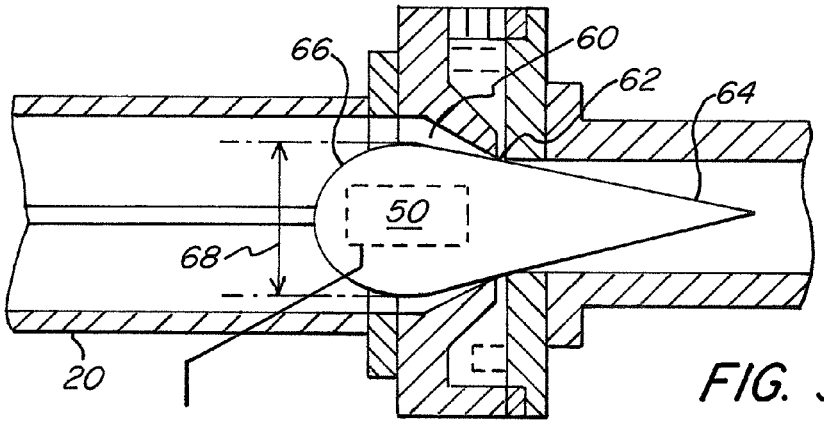

Referring now to FIGS. 3A-3C, shown are partially cross-sectional side views illustrating embodiments of the throttling and shutoff of the intake airflow using the system of FIG. 1. The valve body 52 may be disposed in the air conduit 20, held therein by a holder 54, and be moveable longitudinally therein. The air conduit 20 may have a reduced portion 60, which has a cross-sectional area that decreases in the direction of flow of the conduit 20. As a result, the reduced portion 60 tapers down to produce a small throat 62 representing a minimum diameter of the air conduit 20. As depicted in FIG. 3A, the valve body 52 may have a first end 64 positionable in this reduced portion 60 in order to throttle the airflow therethrough.

In certain advantageous embodiments, a supply part 70 may be employed for introducing recirculated exhaust gas into the air conduit 20, and the valve body 52 may be used to control the mixing of the inlet air and recirculated exhaust gas, such as is disclosed in U.S. Pat. No. 7,036,529 to Berggren et al., the specification of which is hereby incorporated by reference herein in its entirety. Accordingly, to the extent reference is made herein to air or airflow through the air conduit 20, it should be understood that this is meant to include either fresh inlet air, recirculated exhaust gas, and/or a mixture of both.

One advantage of an EGR system in the current system it that during cold starts throttling can be used to increase the EGR-rate beyond normal values in order to comply with (NOx) emission levels without a working SCR (Selective Catalytic Reduction) system and these very high EGR rates will also increase combustion temperature, improving combustion stability, which will also hasten engine warm-up since extensive exhaust heat energy is transferred to the cooling system via the EGR-cooler.

At least one sensor 42 (shown in FIGS. 1 and 2) may be employed to monitor the temperature such that, when the temperature falls below a certain threshold temperature, the processor 44 communicates an appropriate control signal to the actuator 50, which controls the position of the valve body 52. It should be noted that various arrangements may be employed for holding and actuating the valve body 52, such as those disclosed in U.S. Pat. No. 7,036,529 to Berggren et al.

As shown in FIG. 3B, when the actuator 50 receives a control signal, it causes the valve body 52 to move downstream, such that the end 64 of the valve body 52 moves through the reduced portion 60, thereby varying the extent to which the airflow is throttled. As a result, less air flows into the engine 22, and thus, because there is less mass to soak up the heat produced by the combustion, the smaller amount of exhaust gas gets hotter.

The measured or estimated temperature may comprise the only control variable used to generate the control signal, or may comprise only one of a plurality of control variables used to generate the control signal. For example, the system may include at least one additional sensor which senses various additional parameters and generates and transmits to processor 44 sensor signals indicative of such additional parameters, such as those disclosed in U.S. Pat. No. 6,886,545 to Holm, the specification of which is hereby incorporated herein by reference in its entirety.

The valve body 52 has a second end 66. In certain advantageous embodiments, the valve body is a streamlined body, and this second end 66 has a generally ovoid shape, however, the valve body can be any suitable shape in order to vary the venturi. As shown in FIG. 3C, the valve body has a maximum diameter 68 which may be at least as large as (and in some cases, larger than) the minimum diameter of the throat 62. Accordingly, the valve body can be moved to a position that is far enough downstream that the cross-sectional area of the air conduit 20 is completely occluded. In some embodiments, this can be in response to an emergency shutoff signal received by the processor 44 (or separate processor). By limiting the supply of air in this way, the process of engine shutoff can be quicker and less noisy.

Figure 4:
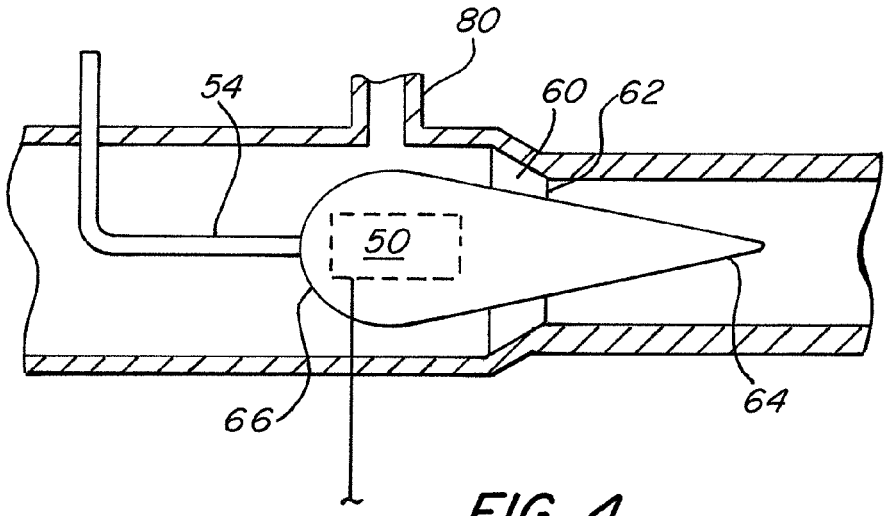
FIG. 4 is a partially cross sectional view of the air conduit of FIG. 3B without the use of a supply part for recirculating exhaust gas.

Though the throttling mechanism illustrated in FIGS. 3A-3C has been shown with reference to an assembly that employs a supply part 70 for introducing recirculated exhaust gas using the venturi effect of the reduced portion 60 of the air conduit 20, it should be noted that the aforementioned throttling of the intake airflow of the engine can likewise be accomplished without the supply part 70. Referring now to FIG. 4, shown is a partially cross sectional view of the air conduit of FIG. 3B without the use of a supply part for recirculating exhaust gas. As is discussed further below, fuel injector 80 may be used to mix fuel with the air prior to reaching the cylinders.

Figure 5:
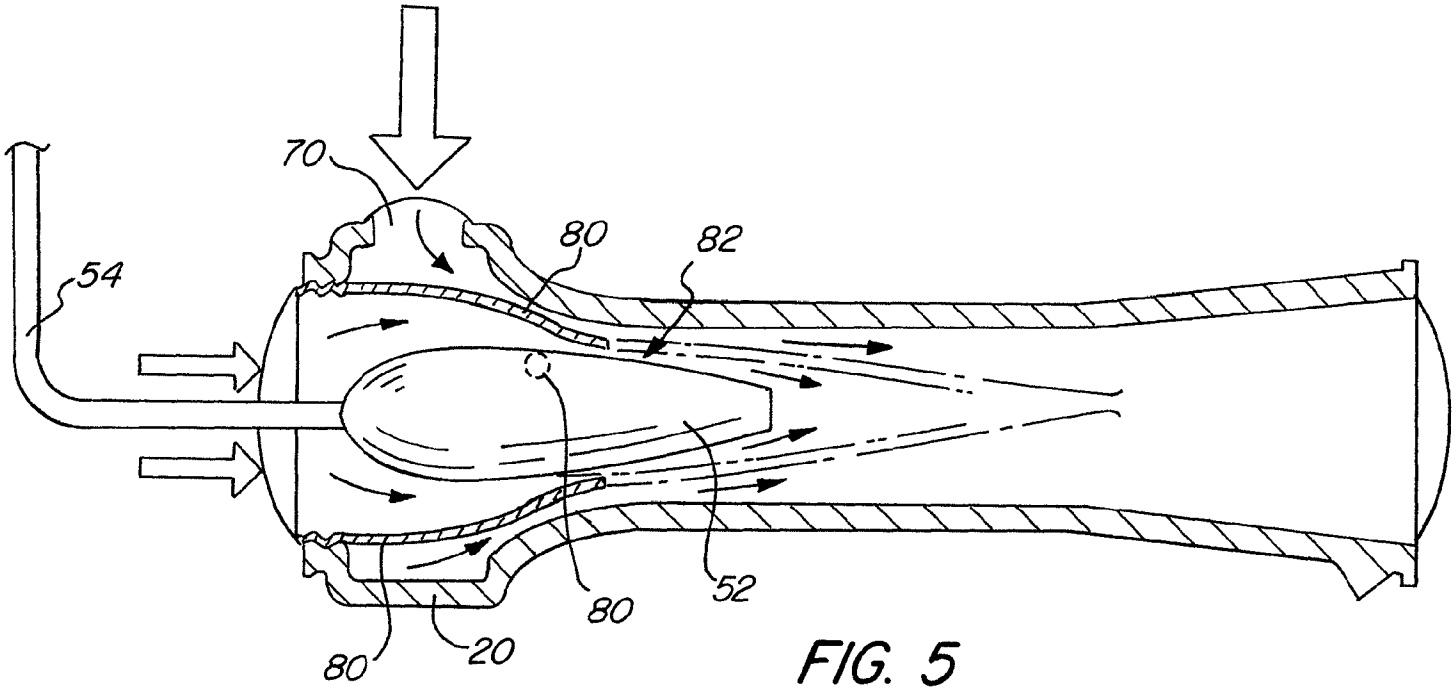
FIG. 5 is a partially cross-sectional side view illustrating embodiments of fuel injection into the intake airflow.

Referring now to FIG. 5, shown is a partially cross-sectional side view illustrating embodiments of fuel injection into the intake airflow. Diesel engines, for example, although not limited thereto, traditionally mix fuel and air inside the cylinder, which results in an inhomogeneous charge and a diffusing flame where the injected amount of fuel must be metered in order to control power output. In one embodiment according to the present teachings, one or more fuel injectors 80 may be used to premix fuel with the intake air and EGR prior to introducing fuel in the cylinder for combustion (e.g., through traditional direct injection, etc.). Therefore, the mix that enters the cylinder includes air, EGR and a preferably non-combustible amount of fuel, although not limited thereto.

The venturi may be used with fuel injection in order to control the EGR and air mix. As discussed above, the valve body 52 may be used to control airflow into the engine. Here, airspeed is very high, providing the opportunity to pre-mix fuel with airflow before it reaches the engine. Fuel injection may be monitored and controlled by one or more sensors 40, although not limited thereto. One problem with premixed charges is that the charge is combustible during engine compression (as compared to a traditional diesel engine, in which only air is compressed with fuel being injected later). When compressing a gas, the temperature rises, and since fuel is present, the homogeneous charge can auto ignite, resulting in uncontrolled combustion (e.g., engine knock, etc.) and engine damage. Therefore, it is desirable to pre-mix the fuel in the air conduit 20 at a level where it is not combustible. When the mix then enters the cylinder 26 and starts to be compressed, a small volume of additional fuel may be introduced (e.g., traditional direct injection, etc.) to get achieve a combustible mix. Pre-mixing fuel before it reaches the cylinder improves fuel consumption because less unburned fuel is leftover, and the additional direct fuel injection in the cylinder mixes better due to the fact that it is a small amount of fuel.

It is appreciated that fuel may be injected into the airflow at any point along the air conduit 20 and the present teachings are not limited to the particular embodiments described herein. However, it is preferable to introduce the fuel in a mixing zone 82 created by the valve body 52. The supply part 70 may have an inlet adjacent to the air conduit 20 positioned at or upstream from the valve body 52. Therefore, fuel may be introduced at or upstream from the valve body 52. Here, the mixing of the intake air and EGR (which enters through the supply part 70) assures an effective mixing with the fuel due in part to the high air speed. The warm EGR also may provide adequate vaporization of the fuel.

In one embodiment, although not limited thereto, the fuel may be introduced by one or more fuel injectors 80. As shown by the fuel injectors 80 above and below the valve body 52 in FIG. 5, one or more fuel injectors 80 may be adjacent to and extend from the air conduit 20. This way, fuel can be introduced with the flow of air at preferable points along the conduit in order to assure adequate mixing of the fuel with the air. If introduced in the mixing zone 82 created by the mixing of intake air and EGR air, the high air speed and heat of the EGR helps to vaporize and mix the fuel.

In another embodiment, at least one of the one or more fuel injectors 80 may extend from the valve body 52. In this embodiment, fuel may enter through the holder 54, although not limited thereto, and be dispersed in the middle of the mixing zone 82 where the air speeds up due to the placement of the valve body 52. Fuel injection through small orifices in the valve body 52 provides decent mixing of the air, EGR and fuel before reaching the cylinders. It is appreciated that the fuel injectors 80, which include one or several fuel injectors 80, may be positioned anywhere along the length of the air conduit 20 and the present teachings are not limited to the exemplary embodiment described herein.

While the present teachings have been described above in terms of specific embodiments, it is to be understood that they are not limited to these disclosed embodiments. Many modifications and other embodiments will come to mind to those skilled in the art to which this pertains, and which are intended to be and are covered by both this disclosure and the appended claims. It is intended that the scope of the present teachings should be determined by proper interpretation and construction of the appended claims and their legal equivalents, as understood by those of skill in the art relying upon the disclosure in this specification and the attached drawings.

What is claimed is:

1. An arrangement for pre-mixing gas flow and fuel in a diesel engine, comprising:

an air conduit having an inlet for a first gas flow and through which air flows to the engine, said air conduit having a reduced portion;

a valve body arranged to be displaced in a longitudinal direction of the air conduit in order to achieve a variable venturi effect and in this way a variable suction, the valve body creating a mixing zone; and one or more fuel injectors for injecting fuel in the air conduit, the one or more fuel injectors positioned at or upstream from the valve body and the mixing zone, the injected fuel mixing with the gas flow in the mixing zone;

wherein fuel injected into the air conduit mixes with the gas flow to create a mixture before said mixture flows to the engine for combustion; and wherein the fuel is diesel fuel.

2. The arrangement of claim 1 wherein at least one of the one or more fuel injectors is adjacent to the air conduit.

3. The arrangement of claim 1 wherein at least one of the one or more fuel injectors is adjacent to the valve body.

4. The arrangement of claim 1 wherein the mixture is not combustible within the air conduit.

5. The arrangement of claim 1 further comprising one or more cylinders, wherein the mixture flows into the one or more cylinders and an additional amount of fuel is injected into the one or more cylinders for combustion of the mixture.

6. The arrangement of claim 1, further comprising:

a supply part having an inlet adjacent to the air conduit for introducing a second gas flow into the air conduit;

wherein the inlet is at or upstream from the valve body; and the first and second gas flows mix with the fuel to create the mixture.

7. The arrangement of claim 6 wherein the first gas flow and the second gas flow comprise an inlet flow and an exhaust gas recirculation flow.

8. The arrangement of claim 6 wherein the valve body penetrates a plane perpendicular to a longitudinal axis of the supply part at the inlet.

9. The arrangement of claim 1, further comprising:

an actuator which displaces the valve body forwards and backwards in the air conduit;

wherein the valve body and the supply part define a venturi therebetween.

10. The system of claim 1, wherein the reduced portion of said air conduit is tapered.

11. The system of claim 1, wherein the end of said valve body positionable in the reduced portion of said air conduit is tapered.

12. The system of claim 11, wherein said valve body has a second end upstream of said tapered end, and wherein said second end is ovoid.

13. The system of claim 1, wherein:

the reduced portion of said air conduit has a minimum diameter;

said valve body has a maximum diameter; and the maximum diameter of said valve body is at least as large as the minimum diameter of said air conduit.

14. The system of claim 13, wherein said valve body is moveable through the reduced portion of said air conduit to an extent that the cross-sectional area of the reduced portion is fully occluded.

15. The arrangement of claim 5 wherein the arrangement is adapted to minimize the fuel injected into the one or more cylinders due to the premixing of the gas flow and the fuel injected in the mixing zone.

16. The arrangement of claim 1 further comprising a sensor, wherein the one or more fuel injectors are monitored and controlled at least in part by the sensor.

17. An arrangement for pre-mixing gas flow and fuel in a diesel engine, comprising:

an air conduit having an inlet for a first gas flow and through which air flows to the engine, said air conduit having a reduced portion;

a valve body arranged to be displaced in a longitudinal direction of the air conduit in order to achieve a variable venturi effect and in this way a variable suction, the valve body creating a mixing zone;

a supply part having an inlet adjacent to the air conduit for introducing a second gas flow into the air conduit, the supply part positioned at or upstream from the valve body; and one or more fuel injectors for injecting fuel in the air conduit, the one or more fuel injectors positioned at or upstream from the valve body and the mixing zone, the injected fuel mixing with the first and second gas flows in the mixing zone;

wherein fuel injected into the air conduit mixes with the gas flows to create a mixture before said mixture flows to the engine for combustion; and wherein the fuel is diesel fuel.

18. The arrangement of claim 17 wherein at least one of the one or more fuel injectors is adjacent to the air conduit.

19. The arrangement of claim 17 wherein at least one of the one or more fuel injectors is adjacent to the valve body.

20. The arrangement of claim 17 wherein the mixture is not combustible within the air conduit.

21. The arrangement of claim 17 further comprising one or more cylinders, wherein the mixture flows into the one or more cylinders and an additional amount of fuel is injected into the one or more cylinders for combustion of the mixture.

22. The arrangement of claim 17 wherein the first gas flow and the second gas flow comprise an inlet flow and an exhaust gas recirculation flow.

23. The arrangement of claim 17, further comprising:

an actuator which displaces the valve body forwards and backwards in the air conduit;

wherein the valve body and the supply part define a venturi therebetween.

24. The arrangement of claim 17 wherein at least one of the one or more fuel injectors comprises an orifice on the valve body.

25. A method for pre-mixing gas flow and fuel in a diesel engine, comprising the steps of:

supplying a first gas flow to an engine through an air conduit having a reduced portion;

positioning a valve body in a longitudinal direction within the air conduit in order to achieve a variable venturi effect and in this way a variable suction, the valve body creating a mixing zone; and injecting fuel in the air conduit at a position at or upstream from the valve body and the mixing zone, the injected fuel mixing with the gas flow in the mixing zone;

wherein the fuel injected into the air conduit mixes with the gas flow to create a mixture before said mixture flows to the engine for combustion; and wherein the fuel is diesel fuel.

26. The method of claim 25, further comprising the step of:

supplying a second gas flow to the air conduit with a supply part having an inlet adjacent to the air conduit;

wherein the inlet is at or upstream from the valve body and the first and second gas flows mix with the fuel to create the mixture.

27. The method of claim 26 wherein the first gas flow and the second gas flow comprise an inlet flow and an exhaust gas recirculation flow.

28. The method of claim 25 wherein the fuel is injected with one or more fuel injectors, and at least one of the one or more fuel injectors is adjacent to the air conduit.

29. The method of claim 25 wherein the fuel is injected with one or more fuel injectors, and at least one of the one or more fuel injectors is adjacent to the valve body.

30. The method of claim 25 wherein the mixture is not combustible within the air conduit.

31. The method of claim 25 wherein the mixture flows into one or more cylinders, further comprising the step of injecting an additional amount of fuel into the one or more cylinders for combustion of the mixture.

32. The arrangement of claim 1 wherein at least one of the one or more fuel injectors comprises an orifice on the valve body.

33. The method of claim 25 wherein the fuel is injected with one or more fuel injectors, and wherein at least one of the one or more fuel injectors comprises an orifice on the valve body.

* * * * *